United States Patent [19]

Hausner

[11] Patent Number: 5,060,948

[45] Date of Patent: Oct. 29, 1991

[54] PUZZLE HAVING MOVEABLE TILES AND TRANSPARENT RETAINER

[76] Inventor: Alan Hausner, 39 Dewey Rd., Cheltenham, Pa. 19012

[21] Appl. No.: 512,649

[22] Filed: Apr. 23, 1990

[51] Int. Cl.[5] ..... A63F 9/08

[52] U.S. Cl. ..... 273/153 S; 273/DIG. 14

[58] Field of Search ..... 273/153 S, 155, 157 A, 273/D14

[56] References Cited

U.S. PATENT DOCUMENTS

| | | | |
|---|---|---|---|
| 535,279 | 3/1895 | Eymann | 273/153 S |
| 4,249,738 | 2/1981 | Troeger | 273/153 S |
| 4,620,709 | 11/1986 | Palladino | 273/153 S |

*Primary Examiner*—Edward M. Coven
*Assistant Examiner*—William M. Pierce

[57] ABSTRACT

Apparatus useful as a puzzle comprising a playing board having a square, flat playing surface, moveable chicklets of equal thickness and of equal square size, at least some of said chicklets decorated so as to form a picture on their appearance surfaces only when said puzzle is solved by moving said chicklets into a solution position, said chicklets being moveable in a horizontal plane along a flat surface within said board, said board having a retaining curb around the border of said flat playing surface and a transparent retaining means parallel to and spaced above said flat playing surface by slightly more than the thickness of said chicklets and adapted to retain said moveable chicklets in a playing area and to permit the player to see the appearance surface of all of said chicklets, said transparent retaining means having open areas through which the player may use a finger to move said chicklets, said open areas being only in positions other than the corner positions and the four central positions, the number of said moveable chicklets being six less than the number of spaces on said flat playing board, the four corner spaces on said flat playing board each having a non-moveable chicklet of equal size to said moveable chicklets so that the number of empty square spaces on said flat playing board equals two at all times.

8 Claims, 2 Drawing Sheets

PUZZLE HAVING MOVEABLE TILES AND TRANSPARENT RETAINER

BACKGROUND OF THE INVENTION

1. Field of the Invention

This invention relates to the field of puzzle devices having a flat playing board and moveable chicklets or tiles which must be manipulated into a particular position on said playing board to solve.

2. Description of the Prior Art

Most people are familiar with the puzzles which have a square or rectangular playing board having a give number of spaces and numbered, colored, or decorated square playing pieces which can be moved on the board, the number of pieces being one less than the number of spaces so that movement of the pieces is restricted to moving one piece at a time into the open space. Frequently this type of puzzle has numbers on each piece, and the solution consists of arranging the pieces in numerical order either horizontally or vertically. Such type of puzzles can be mentally stimulating and challenging for substantial periods of time. See, for example, Coe U.S. Pat. No. 785,665 of Mar. 21, 1905.

SUMMARY OF THE INVENTION

It is an object of the present invention to provide an improved puzzle apparatus which is even more challenging, exciting, and fun than the classic moveable checker type.

This object and others which will become apparent from the following disclosure are achieved by the present invention which comprises in one aspect an apparatus useful as a puzzle comprising a playing board having a square, flat playing surface, moveable chicklets of equal thickness and of equal square size, at least some of said chicklets decorated so as to form a picture on their appearance surfaces only when said puzzle is solved by moving said chicklets into a solution position, said chicklets being moveable in a horizontal plane along a flat surface within said board, said board having a retaining curb around the border of said flat playing surface and a transparent retaining means parallel to and spaced above said flat playing surface by slightly more than the thickness of said chicklets and adapted to retain said moveable chicklets in a playing area and to permit the player to see the appearance surface of all of said chicklets, said transparent retaining means having open areas through which the player may use a finger to move said chicklets, said open areas being only in positions other than the corner positions and the four central positions, the number of said moveable chicklets being six less than the number of spaces on said flat playing board, the four corner spaces on said flat playing board each having a non-moveable chicklet of equal size to said moveable chicklets so that the number of empty square spaces on said flat playing board equals two at all times.

BRIEF DESCRIPTION OF THE DRAWINGS

The drawings illustrate but one of several possible embodiments of the invention.

DETAILED DESCRIPTION OF THE INVENTION AND THE PREFERRED EMBODIMENTS

Figure 1:
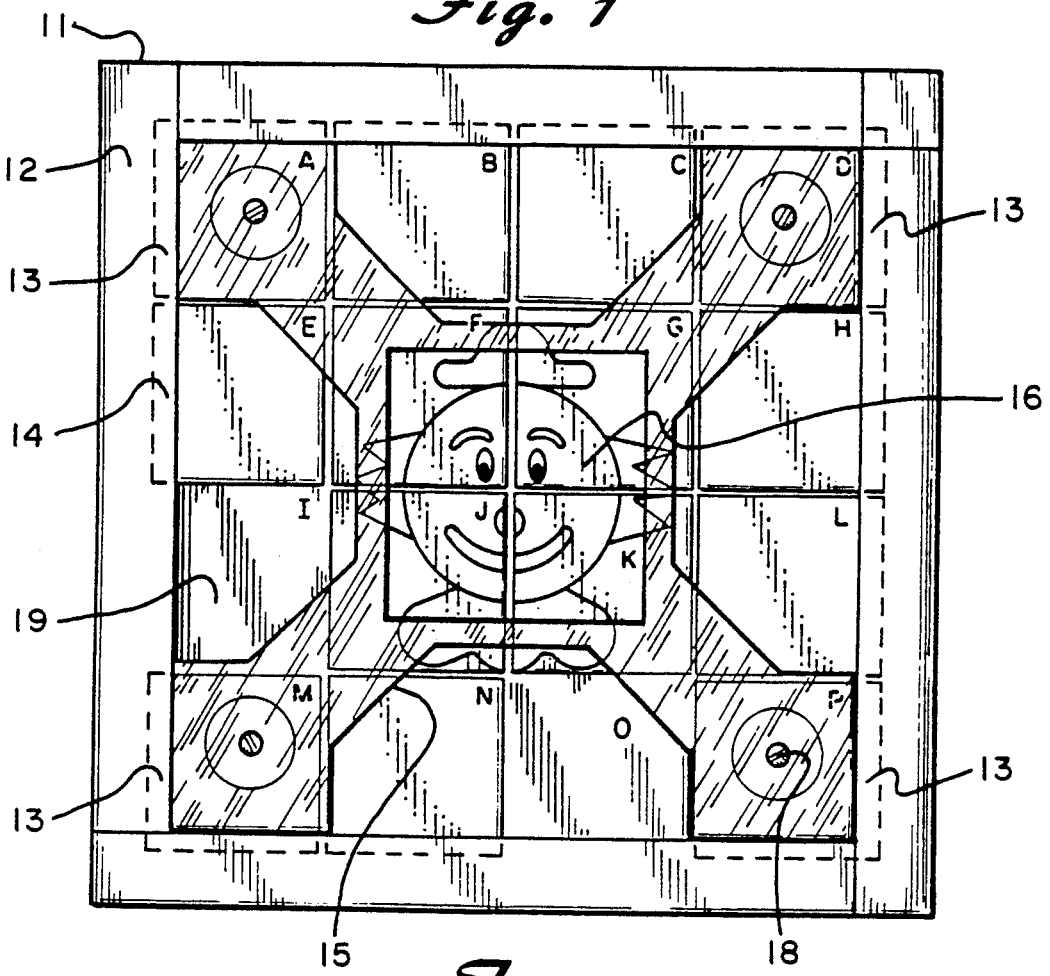
FIG. 1 shows a top plan view of an apparatus according to the invention.
Figure 2:
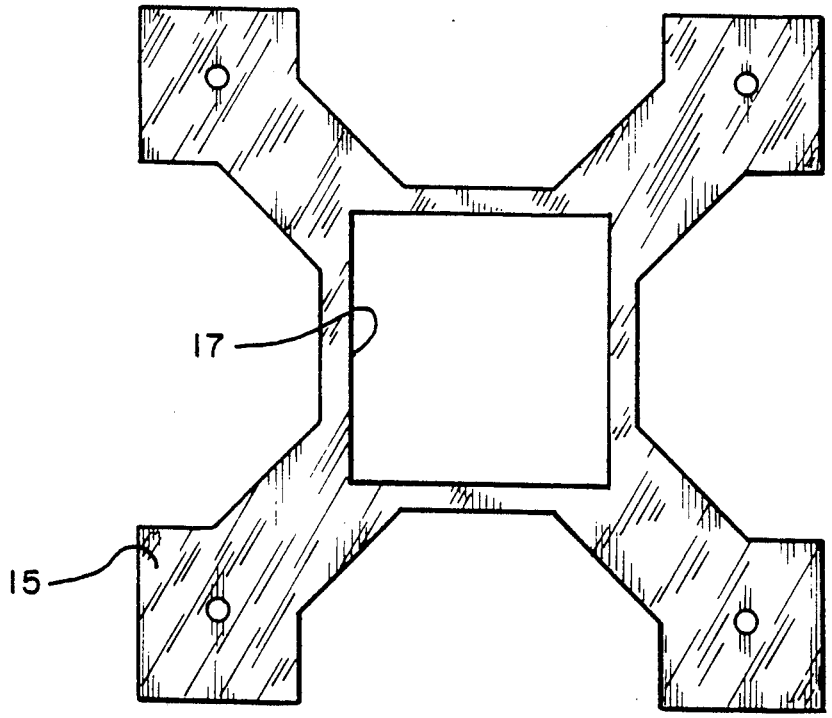
FIG. 2 illustrates the transparent retaining means of the invention.
Figure 3:
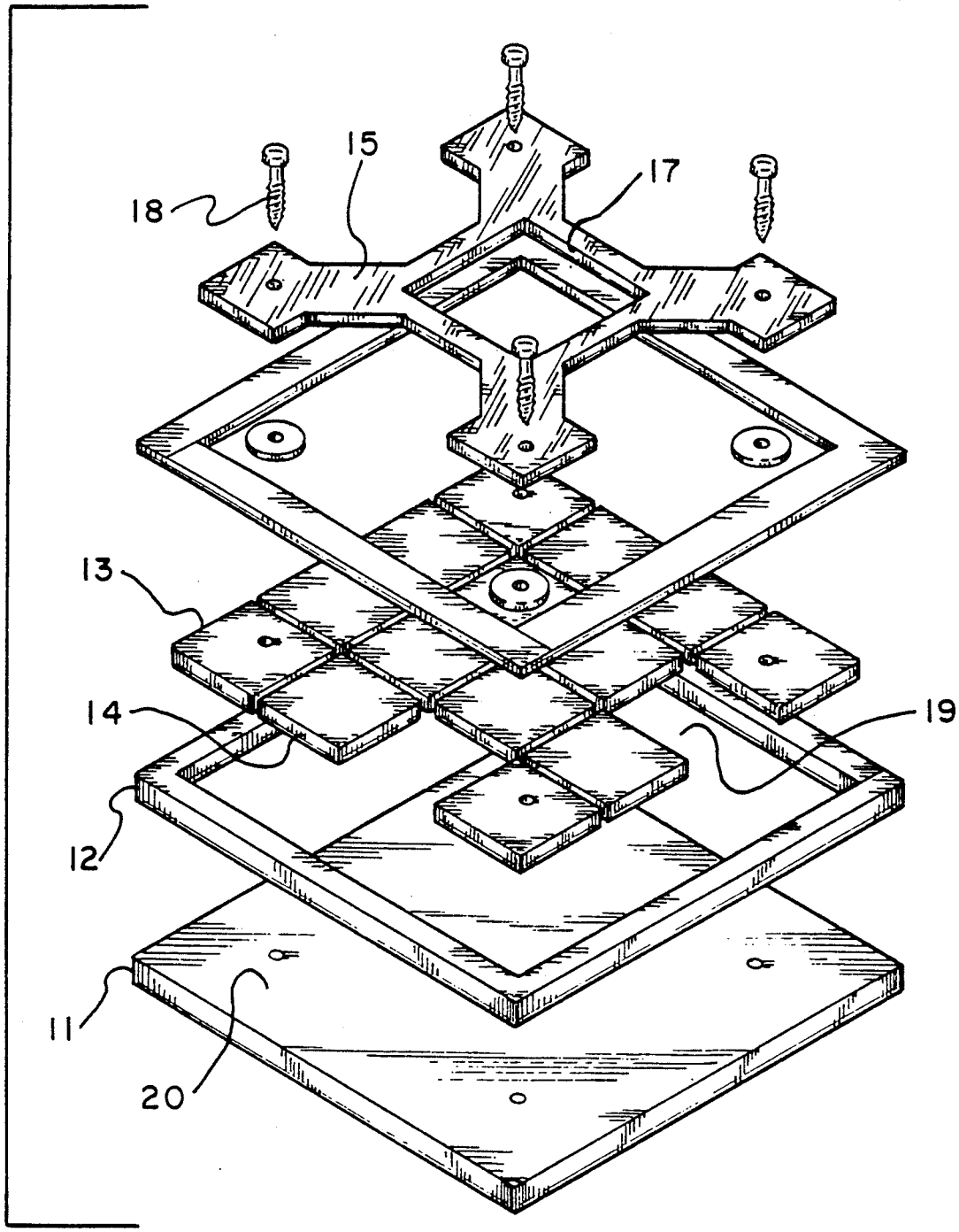
FIG. 3 illustrates an expanded view of a puzzle apparatus according to the invention from the top and side.

Referring to the drawings, FIG. 1 illustrates one embodiment of the invention wherein the apparatus 11 useful as a puzzle comprises a playing board having a square, flat playing surface 20 (FIG. 3), moveable chicklets 14 of equal thickness and of equal square size, at least some of said chicklets decorated so as to form a picture 16 on their appearance surfaces only when said puzzle is solved by moving said chicklets into a solution position (FIG. 1), said chicklets being moveable in a horizontal plane along a flat surface within said board, said board having a retaining curb 12 around the border of said flat playing surface and a transparent retaining means 15 parallel to and spaced above said flat playing surface by slightly more than the thickness of said chicklets. Corner, non-moveable chicklets 13 in FIGS. 1 and 3 serve to space the transparent retaining means 15 at the correct distance above the surface of the playing surface 20 and adapted to retain said moveable chicklets 14 in a playing area and to permit the player to see the appearance surface of all of said chicklets, said transparent retaining means 15 having open areas through which the player may use a finger to move said chicklets, said open areas being only in positions other than the corner positions and the four central positions, the number of said moveable chicklets being six less than the number of spaces on said flat playing board, i.e., nine in the case of a $4\times4$ board, nineteen in the case of a $5\times5$ board.

The four corner spaces 13 on said flat playing board 20 each have a non-moveable chicklet 13 of equal size to said moveable chicklets so that the number of empty square spaces on said flat playing board equals two at all times. The chicklets may be moved to play the puzzle by pushing the chicklets in spaces B, C, E, H, I, L, N or O in FIG. 1, depending where one of the two open spaces on the board is at the particular time. The two empty spaces can not be next to each other at any time. The object is to move the chicklets into an array or position so that the solution appearance, e.g., the clown face in FIG. 1, is visible through the transparent retaining means 15. The player has only two choices—either to move one chicklet to an adjacent empty space or to push three chicklets to an empty space across the transparent retaining means which acts as a barrier.

Each square chicklet 13 is one sixteenth or one twenty-fifth or one thirty-sixth, etc., the size of said square, flat playing surface. Although not illustrated, the flat surface 20 can be decorated so that when a space is unoccupied by a chicklet, said decoration is visible. Also not illustrated is an embodiment wherein said chicklets have horizontal grooves on each of their sides adapted to engage horizontal disks which are supported on posts and spaced above said flat surface at a level equal to the distance between said grooves and the bottom of said chicklets, said chicklets having a square shape below said groove which is a smaller square than the square shape above said groove, said smaller square being of a size so as not to interfere with the engagement of said disk in said groove when said chicklets are moved along said flat playing surface. The decoration consists of painting, decal, coating, or material selection. By material selection is meant, for example, the selection of wood, plastic, and the like, which may give a desired appearance because of differences between various woods used.

While one embodiment has been more extensively illustrated and discussed, many other embodiments should become readily apparent to those skilled in the art without departing from the spirit and scope of the invention as set forth in the following claims.

What is claimed is:

1. Apparatus useful as a puzzle comprising a playing board having a square, flat playing surface, moveable chicklets of equal thickness and of equal square size, at least some of said chicklets decorated so as to form a picture on the appearance surfaces of said chicklets only when said puzzle is solved by moving said chicklets into a solution position, said chicklets being moveable in a horizontal plane along a flat surface within said board, said board having flat playing surface, a boarder around said flat playing surface, a retaining curb around said border and a transparent retaining means parallel to and spaced above said flat playing surface and adapted to retain said moveable chicklets in a playing area and to permit the player to see the appearance surface of all of said chicklets, said transparent retaining means having open areas through which the player may use a finger to move said chicklets, said open areas being only in positions other than the corner positions and the four central positions, said flat playing surface having a number of spaces, the number of said moveable chicklets being six less than said number of spaces on said flat playing board, said flat playing surface having four corner spaces each having a non-moveable chicklet of equal size to said moveable chicklets, said flat playing board having two empty square spaces at all times.

2. Apparatus according to claim 1 wherein each square chicklet is one twenty-fifth the size of said square, flat playing surface.

3. Apparatus according to claim 1 having four certain chicklets which, in turn, have indicia wherein the solution to the puzzle is indicated when four certain chicklets occupy said four central positions.

4. Apparatus according to claim 1 wherein said flat surface is decorated so that when a space is unoccupied by a chicklet, said decoration is visible.

5. Apparatus according to claim 1 wherein said decoration consists of painting, decal, coating, or material selection.

6. Apparatus according to claim 1 wherein each square chicklet is one sixteenth the size of said square, flat playing surface.

7. Apparatus according to claim 6 wherein said transparent retaining means covers said non-moveable chicklets and a space over a central area of said flat playing surface corresponding in size to four chicklets.

8. Apparatus according to claim 6 wherein said chicklets have sides and horizontal grooves on each of said sides adapted to engage horizontal disks which are supported on posts and spaced above said flat surface at a level equal to the distance between said grooves and the bottom of said chicklets, said chicklets having a square shape above said groove and a square shape below said groove which is a smaller square than said square shape above said groove, said smaller square being of a size so as not to interfere with the engagement of said disk in said groove when said chicklets are moved along said flat playing surface.

* * * * *